US007418790B2

(12) United States Patent
Kerrigan

(10) Patent No.: US 7,418,790 B2
(45) **Date of Patent: *Sep. 2, 2008**

(54) CANTILEVERED SHOE CONSTRUCTION

(76) Inventor: D. Casey Kerrigan, 525 Rookwood Pl., Charlottesville, VA (US) 22903

( * ) Notice: Subject to any disclaimer, the term of this patent is extended or adjusted under 35 U.S.C. 154(b) by 337 days.

This patent is subject to a terminal disclaimer.

(21) Appl. No.: 11/235,688

(22) Filed: Sep. 26, 2005

(65) Prior Publication Data

US 2006/0048412 A1 Mar. 9, 2006

Related U.S. Application Data

(63) Continuation-in-part of application No. 10/429,936, filed on May 5, 2003, now Pat. No. 6,948,262, which is a continuation-in-part of application No. 09/825,260, filed on Apr. 3, 2001, now Pat. No. 6,725,578.

(60) Provisional application No. 60/625,814, filed on Oct. 27, 2004, provisional application No. 60/427,663, filed on Nov. 19, 2002, provisional application No. 60/415,925, filed on Oct. 3, 2002.

(51) Int. Cl.
*A43B 13/28* (2006.01)

(52) U.S. Cl. ..... 36/27; 36/28

(58) Field of Classification Search ..... 36/27, 36/28, 7.8, 143, 144, 151, 152, 157, 158, 36/168, 171, 179, 91
See application file for complete search history.

(56) References Cited

U.S. PATENT DOCUMENTS

| | | | |
|---|---|---|---|
| 717,523 | A | 1/1903 | Arrowsmith |
| 931,353 | A | 8/1909 | Riley |
| 957,718 | A | 5/1910 | Schumacher |
| 1,039,396 | A | 9/1912 | Hilgert |
| 1,103,914 | A | 7/1914 | Eaton |
| 1,187,578 | A | 6/1916 | Watrous |
| 1,199,911 | A | 10/1916 | MacFarland |
| 1,287,810 | A | 12/1918 | Wojteck |
| 1,418,048 | A | 5/1922 | Abramowitz |

(Continued)

FOREIGN PATENT DOCUMENTS

| | | |
|---|---|---|
| DE | 10 55 400 B | 4/1959 |

(Continued)

OTHER PUBLICATIONS

D. Casey Kerrigan, et al., Effectiveness of a Lateral-Wedge Insole on Knee Varus Torque in Patients with Knee Osteoarthritis, Arch Phys Med Rehabil vol. 83, pp. 889-893, Jul. 2002.

(Continued)

*Primary Examiner*—Ted Kavanaugh
(74) *Attorney, Agent, or Firm*—Bromberg & Sunstein LLP

(57) ABSTRACT

A foot support includes a foot supporting structure having a lateral side and a medial side. The foot supporting structure is adapted to provide support to the underside of weight-bearing portions of a user's foot. An anchoring structure beneath the foot supporting structure is connected to the lateral side of the foot supporting structure and not connected to the medial side so that the medial side of the foot supporting structure forms a cantilever arm projecting out from the lateral side.

12 Claims, 9 Drawing Sheets

U.S. PATENT DOCUMENTS

| | | | | |
|---|---|---|---|---|
| 1,477,750 | A | 12/1923 | Endrea | |
| 1,477,825 | A | 12/1923 | Heitler | |
| 1,690,837 | A | 11/1928 | Rehle | |
| 1,696,786 | A | 12/1928 | Wood | |
| 1,698,003 | A | 1/1929 | Rieke | |
| 1,806,409 | A | 5/1931 | Nickerson | |
| 1,832,659 | A | 11/1931 | Riley | |
| 1,928,634 | A | 10/1933 | Spicer et al. | |
| 2,022,247 | A | 2/1935 | Lobel | |
| 1,996,215 | A | 4/1935 | Sabiston et al. | 37/71 |
| 2,043,396 | A | 6/1936 | Schnellbacher | |
| 2,128,402 | A | 8/1938 | Chelmo | |
| 2,135,504 | A | 11/1938 | Hack | 36/8.5 |
| 2,188,182 | A | 1/1940 | Gould | 36/71 |
| 2,227,429 | A | 1/1941 | Austin | |
| 2,266,369 | A | 12/1941 | Kohn | 12/133 |
| 2,295,212 | A | 9/1942 | Hamel | |
| 2,369,226 | A | 2/1945 | Gordon | 36/8.5 |
| 2,512,350 | A | 6/1950 | Ludlam | |
| 2,576,247 | A | 11/1951 | Woodthorpe | 36/71 |
| 2,698,490 | A | 1/1955 | Goldman | 36/8.5 |
| 2,769,251 | A | 11/1956 | Elsey | 36/8.5 |
| 2,862,313 | A | 12/1958 | Jones | 36/71 |
| 3,086,532 | A | 4/1963 | Mistarz | 128/586 |
| 3,586,003 | A | 6/1971 | Baker | 128/586 |
| 3,951,407 | A | 4/1976 | Calacurcio | 273/32 C |
| 4,166,329 | A | 9/1979 | Herbig | 36/97 |
| 4,170,233 | A | 10/1979 | Bunsick | 128/586 |
| 4,258,480 | A | 3/1981 | Famolare, Jr. | 36/91 |
| 4,342,158 | A | 8/1982 | McMahon et al. | 36/35 R |
| 4,372,058 | A | 2/1983 | Stubblefield | 36/32 R |
| 4,398,357 | A | 8/1983 | Batra | 36/30 A |
| 4,527,345 | A | 7/1985 | Lopez | 36/127 |
| 4,619,056 | A | 10/1986 | Lin et al. | 36/43 |
| 4,674,206 | A | 6/1987 | Lyden | 36/88 |
| 4,689,898 | A | 9/1987 | Fahey | 36/43 |
| 4,785,557 | A | 11/1988 | Kelley et al. | 36/32 R |
| 4,798,010 | A | 1/1989 | Sugiyama | 36/30 R |
| 4,862,605 | A | 9/1989 | Gardner et al. | 36/43 |
| 4,910,884 | A | 3/1990 | Lindh et al. | 36/28 |
| 5,282,326 | A | 2/1994 | Schroer, Jr. et al. | 36/44 |
| 5,319,866 | A | 6/1994 | Foley et al. | 36/91 |
| 5,337,492 | A | 8/1994 | Anderie et al. | 36/28 |
| 5,345,701 | A | 9/1994 | Smith | 36/144 |
| 5,400,528 | A | 3/1995 | Skinner et al. | 36/161 |
| 5,463,824 | A | 11/1995 | Barna | 36/44 |
| 5,560,126 | A | 10/1996 | Meschan et al. | 36/42 |
| 5,678,327 | A | 10/1997 | Halberstadt | 36/27 |
| 5,727,335 | A | 3/1998 | Kousaka et al. | 36/31 |
| 5,729,912 | A | 3/1998 | Gutkowski | 36/97 |
| 5,940,994 | A | 8/1999 | Allen | 36/168 |
| 6,345,455 | B1 | 2/2002 | Greer, Jr. et al. | 36/155 |
| 6,598,320 | B2 | 7/2003 | Turner et al. | 36/28 |
| 6,694,642 | B2 | 2/2004 | Turner | 36/28 |
| 6,722,058 | B2 | 4/2004 | Lucas et al. | 36/28 |
| 6,948,262 | B2 * | 9/2005 | Kerrigan | 36/27 |
| 2002/0139011 | A1 | 10/2002 | Kerrigan | 36/144 |
| 2003/0208929 | A1 | 11/2003 | Lucas et al. | 36/28 |
| 2004/0040183 | A1 | 3/2004 | Kerrigan | 36/144 |

FOREIGN PATENT DOCUMENTS

| | | | |
|---|---|---|---|
| DE | 1 147 870 | | 12/1959 |
| DE | 3735496 | A1 | 5/1989 |
| DE | 203 05 000 | U | 7/2003 |
| DE | 102 12 862 | C1 | 10/2003 |
| DE | 102 34 913 | A1 | 2/2004 |
| DE | 102 44 433 | A1 | 4/2004 |
| DE | 101 12 821 | B9 | 10/2004 |
| EP | 0 394 119 | | 10/1990 |
| FR | 624148 | | 11/1926 |
| FR | 2 838 613 | | 10/2003 |
| GB | 438481 | | 11/1935 |
| JP | 11197308 | | 12/1999 |

OTHER PUBLICATIONS

Luoma, Marja, Int'l Search Report, PCT/US2005/034722, Jan. 13, 2006.

* cited by examiner

CANTILEVERED SHOE CONSTRUCTION

The present application is a continuation-in-part of U.S. application Ser. No. 10/429,936, filed May 5, 2003, which in turn was a continuation-in-part of U.S. application Ser. No. 09/825,260, filed Apr. 3, 2001, and also claimed priority from U.S. provisional application 60/415,925, filed Oct. 3, 2002, and from U.S. provisional application 60/427,663, filed Nov. 19, 2002. The present application also claims priority from U.S. provisional patent application 60/625,814, filed Oct. 27, 2004. All of those applications are incorporated herein by reference.

FIELD OF THE INVENTION

Embodiments of the present invention relate to footwear construction and more specifically, to footwear construction that provides dynamic support where and when it is needed in accordance with natural coronal gait dynamics so as to reduce injury and fatigue, while simultaneously increasing performance.

BACKGROUND ART

Increasingly it is recognized that cushioning and standard medial support structures, the two historic linchpins of comfort and athletic footwear design, can interfere with natural biomechanics and muscle function such that they may compromise both performance and long-term musculoskeletal health. Typical cushioning mechanisms to absorb shock at initial contact adversely alter proprioceptive input required for appropriate muscle tuning throughout the body, compromising bone health and predisposing to musculoskeletal injury. Moreover, cushioning materials or mechanisms designed to reduce shock at initial contact may actually increase certain knee and hip joint torques or forces which have been linked to the development of knee and hip osteoarthritis.

Although many shoe designs with arch support or medial post support or mechanisms can support the medial side of the foot, including the natural arch of the foot, they affect only the anatomy of the foot and can adversely increase pressure through the medial part of the foot thus also increasing certain torques and forces, in particular knee varus torque, which has been directly linked to the predisposition to knee osteoarthritis. Arch support structures or mechanisms also restrict the natural, yet sophisticated, action of the foot, thereby inhibiting the body's natural, intrinsic mechanism to absorb forces throughout the body. Additionally, standard medial support mechanisms (as well as standard cushioning or shock absorbing mechanisms) that increase coronal or frontal plane joint torques simultaneously reduce efficiency by necessitating increased muscle energy to counterbalance those increased torques.

SUMMARY OF THE INVENTION

There is a need for a footwear design that both comfortably and adequately supports the foot, yet does not simultaneously increase joint torques or forces, particularly coronal plane torques at the knee and hip. Such a design would be particularly useful for helping prevent knee and hip osteoarthritis as well as other common musculoskeletal injuries such as hip pointers and illiotibial band syndrome. Furthermore, a footwear design that stores and releases energy in the coronal plane would reduce strain and fatigue in additional injury prone areas, reducing the propensity for common syndromes such as shin splints, patellofemoral pain, plantar fasciitis, and metatarsalgia. Such a design would improve energy efficiency and athletic performance through two mechanisms. First, by minimizing coronal plane joint torques, the design would reduce the need for inefficient counterbalancing muscle activity in the coronal plane to maintain posture. Second, the design, by working in the coronal plane, would be unique in consistently storing and releasing energy at the precise time that is needed to improve efficiency.

Embodiments of the present invention include a foot support for supporting weight-bearing portions of a user foot. The foot support includes a foot supporting structure with a lateral side and a medial side. An anchoring structure beneath the foot supporting structure is connected to the lateral side of the foot supporting structure and not connected to the medial side so that the medial side of the foot supporting structure forms a cantilever arm projecting out from the lateral side. The foot supporting structure and the anchoring structure cooperate in the foot support which is adapted to provide support to weight-bearing portions of a user foot.

In further embodiments, the foot support may be discontinuous along its length. The foot supporting structure or the anchoring structure or both may extend continuously or discontinuously along a longitudinal axis of the foot support. The foot supporting structure may extend beyond the longitudinal length of the anchoring structure, or the anchoring structure may extend beyond the longitudinal length of the foot supporting structure. The medial side of the foot supporting structure may be adapted to contact an underlying shoe structure during weight-bearing activities so that the underlying shoe structure provides some support to the medial side of the foot supporting structure. The medial side of the foot supporting structure may be connected to an upper of a shoe. The foot support may change shape during use, for example, an angle between the foot supporting structure and the anchoring structure may change shape. For example, the angle between the foot supporting structure and the anchoring structure may be less during loading than at foot strike or push off. There may be a bend in the foot support at the lateral side of the foot support.

Embodiments of the present invention also include a shoe containing a foot support according to any of the above.

DETAILED DESCRIPTION OF SPECIFIC EMBODIMENTS

Figure 1:
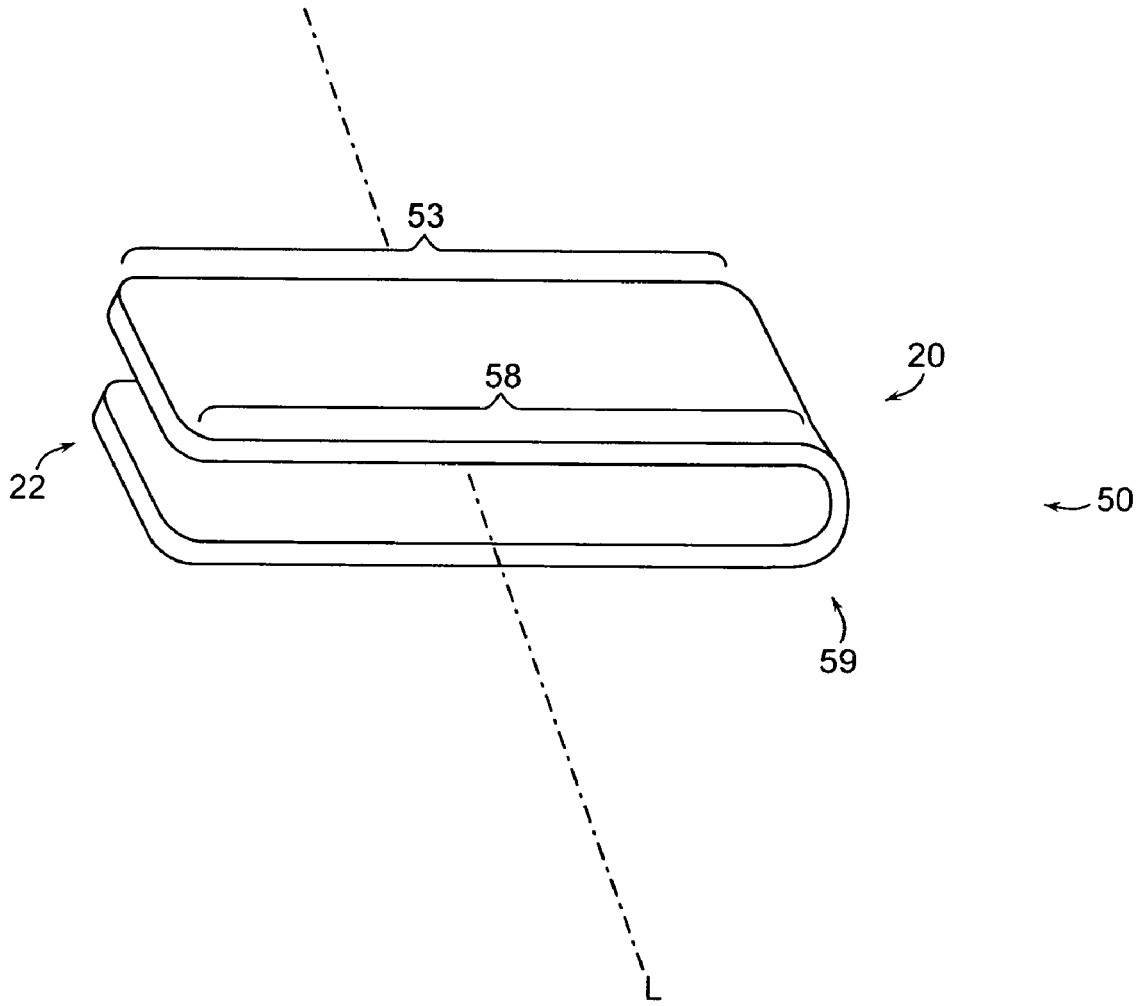
FIG. 1 shows a perspective view of a cantilevered foot support according to one embodiment of the present invention.

FIG. 1 illustrates a cantilevered foot support 50 according to one embodiment of the present invention. The foot support 50 includes a lateral side 20, a medial side 22, and a foot supporting structure 58. FIG. 1 shows that the foot support may be adapted to provide support to the underside of weight-bearing portions of a user foot, such as the forefoot area and/or the heel area.

Figure 2:
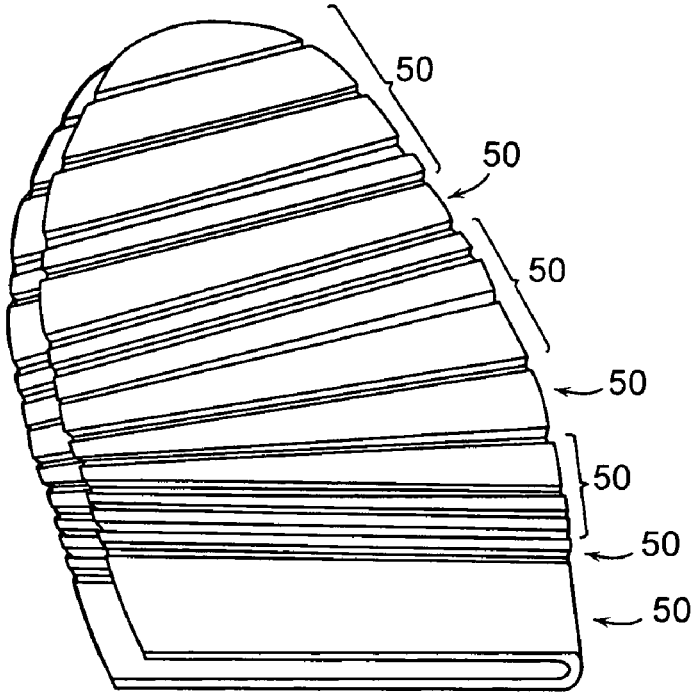
FIG. 2 illustrates a perspective view of a series of cantilevered foot supports according to one embodiment of the present invention.
Figure 2:
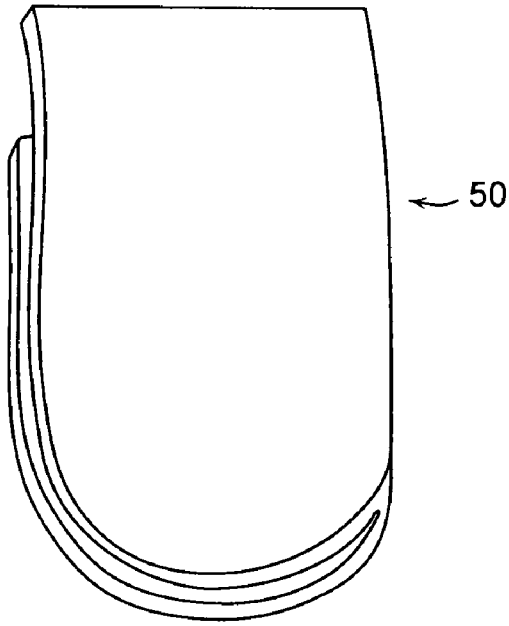
Figure 7A:
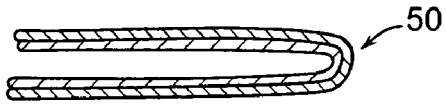
FIGS. 7A-D illustrate perspective views of the possible variations in shape of the cantilevered foot support according to the present invention.
Figure 7B:
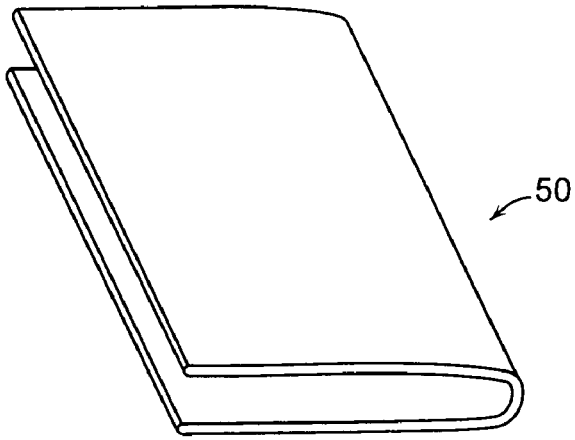

As illustrated in FIG. 1, the foot support 50 may have a size such that it extends the full width of the foot along portions or the entire length of the foot support. Alternatively, the foot support 50 may have a size such that it extends across part of the width of the foot or greater than the width of the foot, along portions or the entire length of the foot support. In another embodiment of the invention, the foot support 50 may be discontinuous along the length of the foot, or alternatively, two or more foot supports 50 may be present. For example, the weight-bearing forefoot and or heel regions of the foot may be supported by one or more foot supports 50. One example of a series of cantilevered foot supports from heel to toe is illustrated in FIG. 2. The foot support 50 may extend for a considerable length along the longitudinal axis of the foot, as illustrated in FIG. 2 or FIG. 7B, or may extend for a very short length as illustrated in FIG. 2 or FIG. 7A.

An anchoring structure 59 beneath the foot supporting structure 58 of the foot support 50 may extend medially from the lateral side 20, as illustrated in FIG. 1. In one embodiment of the present invention, the foot supporting structure element 58 is supported solely by attachment at one or more portions to the anchoring structure 59 of the foot support 50, such that its medial support element 53 completely floats above the underlying structure, as illustrated in FIG. 1, forming a cantilevered arm projecting out from the lateral side of the foot supporting structure 58. In such an embodiment, the medial support element 53 of foot support 50 is completely cantilevered.

Figure 4A:
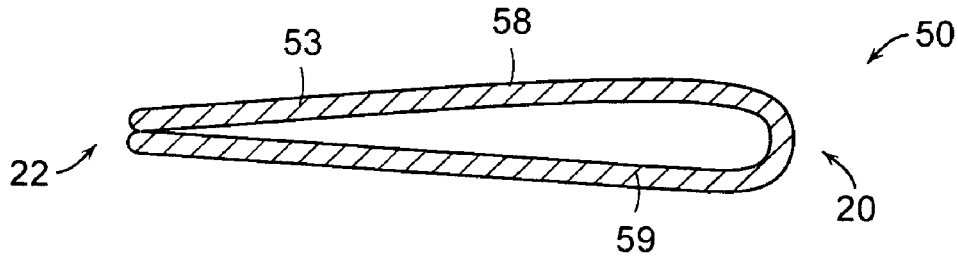
FIGS. 4A-D illustrate cross-sectional views of possible embodiments of the present invention during the loading phase which have inherent structures or external components that provide additional support for the medial part of the foot such that the medial side of the support is partially cantilevered during at least a portion of the gait cycle.
Figure 4B:
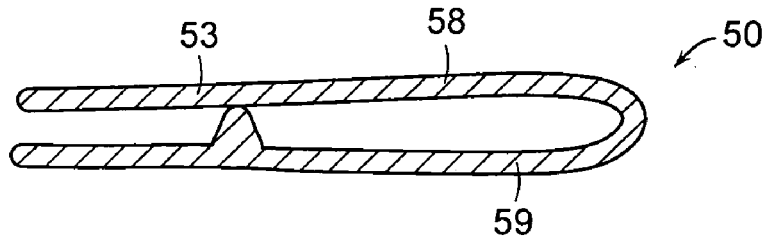
Figure 4C:
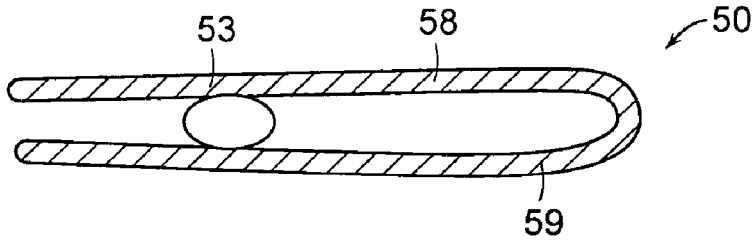
Figure 4D:
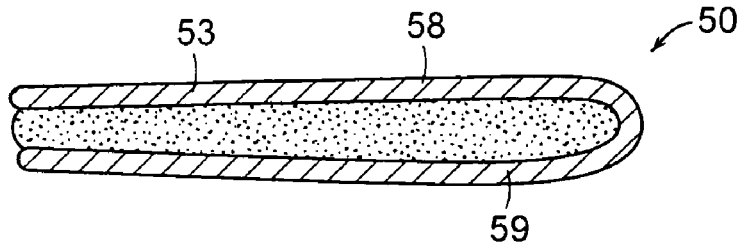

Attachment of foot supporting structure 58 to anchoring structure 59 of the foot support 50, where the foot supporting structure 58 extends horizontally in the manner of a cantilever beyond the points of its attachment to anchoring structure 59 of the foot support 58 provides some and preferably the major portion of the support for the medial foot during weight bearing, with additional upward support derived from other sources within the shoe 30, such as from contact of the medial support element 53 with the anchoring structure 59 itself, illustrated in FIGS. 4A and B, or through additional sources within the foot support 50, illustrated in FIGS. 4C and D, or from other sources within the shoe 30. That is, the medial side 22 of the foot supporting structure 58 is partially cantilevered at all times or solely during weight bearing or loading. Herein, the term cantilevered refers to a design where the medial side 22 of the foot supporting structure 58 and in particular its medial support element 53 derives substantial upward supporting force from its attachment along its lateral side to anchoring structure 59 of foot support 50. Thus, in some embodiments, the medial side of the foot supporting structure 58 may be adapted to contact some portion of the underlying shoe structure during weight-bearing activities so that the underlying shoe structure provides some support to the medial side of the foot supporting structure 58. For example, the medial side may contact a portion of the underlying anchoring structure 59, or a portion of a shoe upper 38.

Figure 5A:
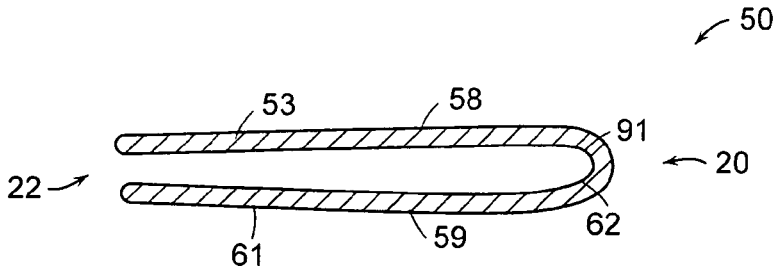
FIGS. 5A-E illustrate cross-sectional views of possible variations in shape of the cantilevered foot support according to the present invention.
Figure 5B:
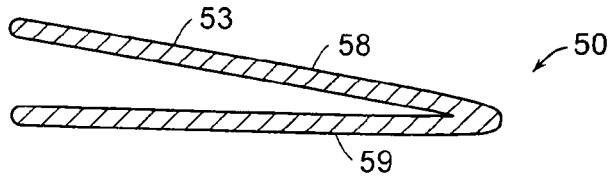

The lateral side 20 of foot support 50 may include a bend. FIG. 5A illustrates an embodiment where foot support 50 comprises material with a U-shaped bend 91 at the lateral side 20 of the foot support 50. In this case, anchoring structure 59 comprises lower element 61 and rising element 62, the latter connecting with the foot supporting structure 58. Alternatively, the foot support 50 comprises material with a V-shaped bend, illustrated in FIG. 5B. The width of anchoring structure 59 may vary, corresponding to the full width of the foot, to less than or greater than the full width.

Figure 5C:
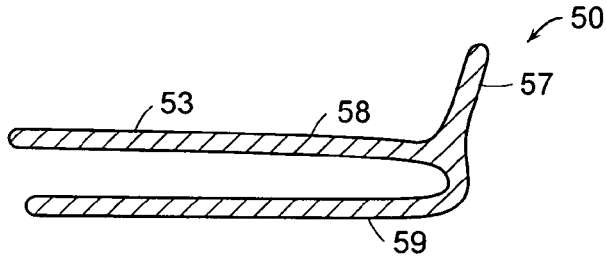
Figure 5D:
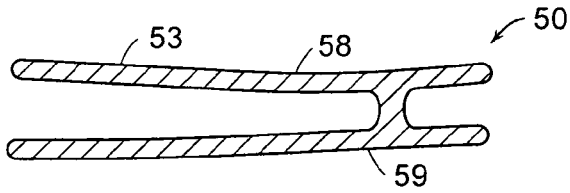
Figure 5E:
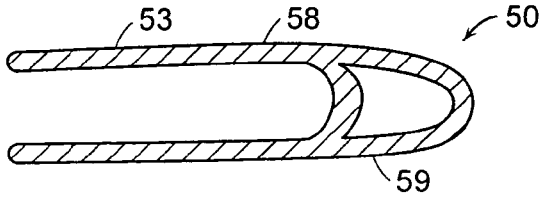
Figure 6A:
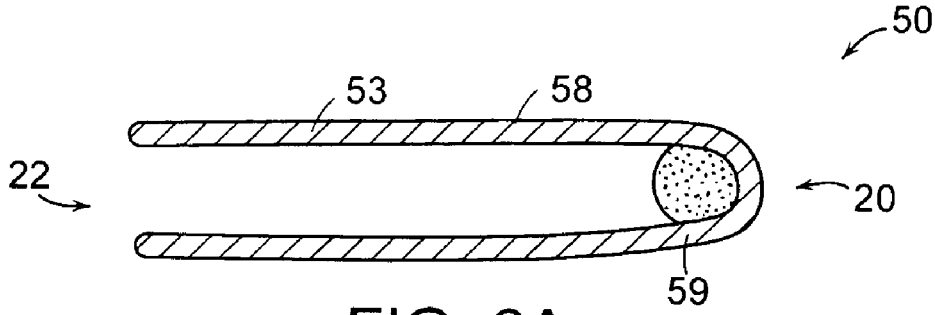
FIGS. 6A-D illustrate cross-sectional views of the present invention in embodiments comprising different combinations of materials to form the cantilevered foot support.
Figure 6B:
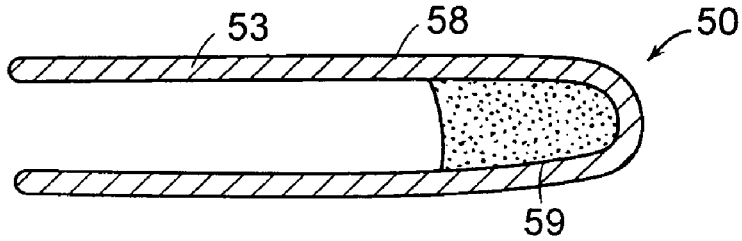
Figure 6C:
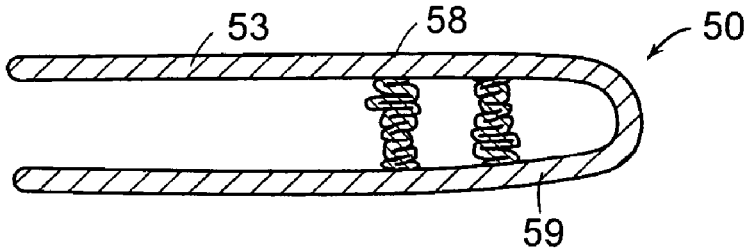
Figure 6D:
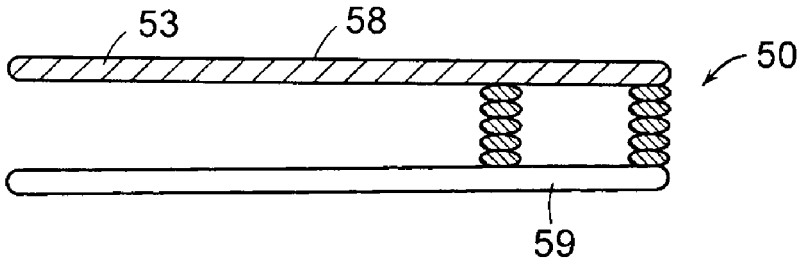
Figure 7D:
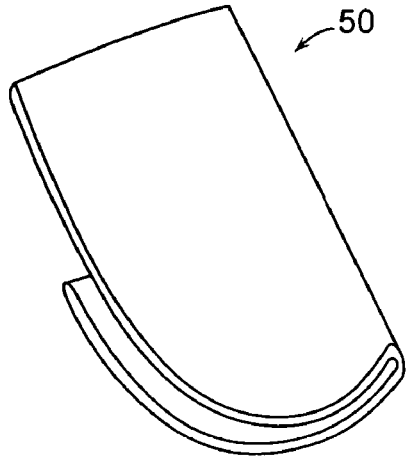
Figure 7C:
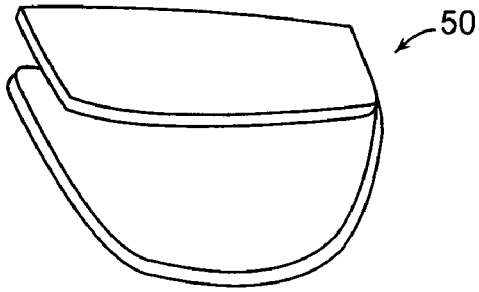
Figure 9:
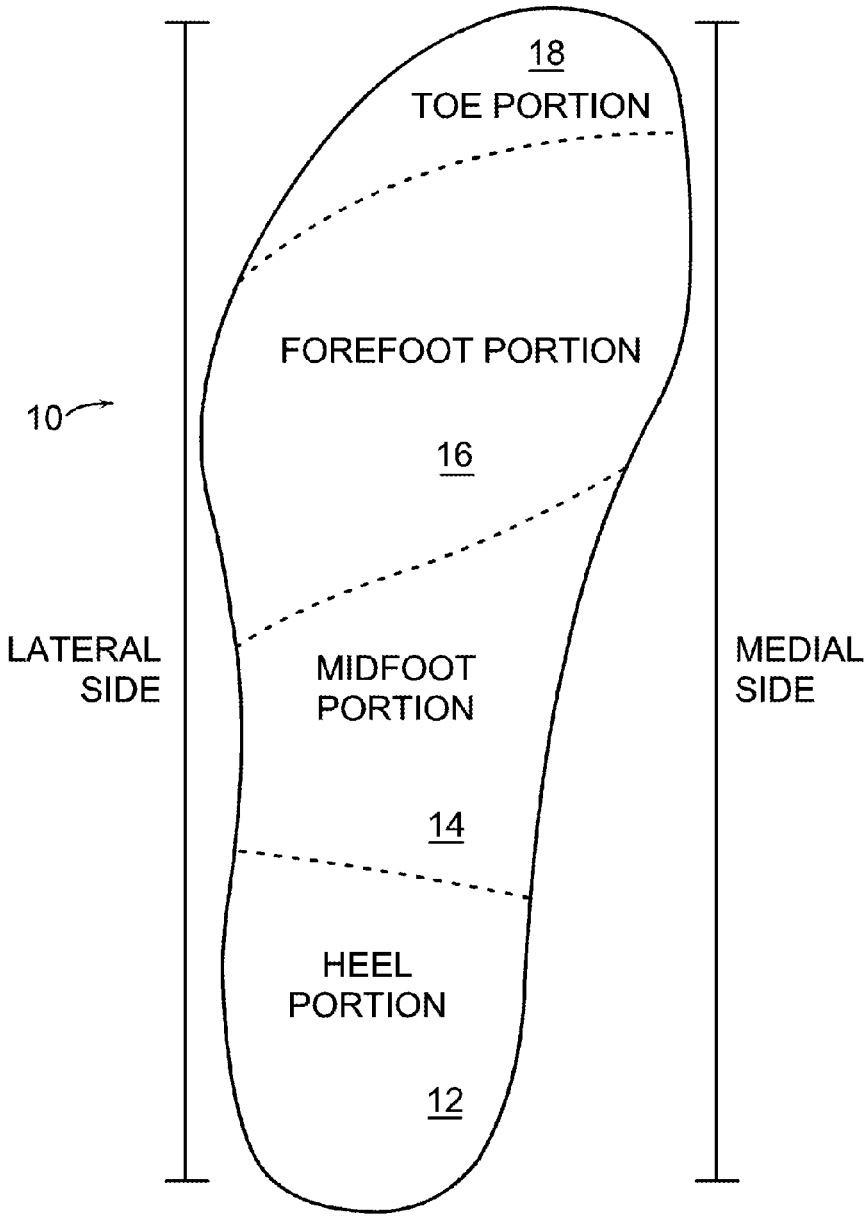
FIG. 9 PRIOR ART
FIG. 9 illustrates a top-view of the prior art portions of a foot.

FIG. 9 illustrates the various portions of a foot 10, including the heel portion 12, midfoot portion 14, forefoot portion 16, and toe portion 18. The foot supporting structure 58 may be relatively flat or may have a variety of shapes. The size and shape of foot supporting structure 58 may change along its length and may be discontinuous along the length of the foot support 50. The foot supporting structure 58 may be planar or convex, may be shaped at the heel to accommodate the heel, at the midfoot region to accommodate the foot's natural arch, and at the forefoot and toes to accommodate the anatomy. The foot supporting structure 58 may extend beyond the anchoring structure 59, laterally as illustrated in FIG. 5D, longitudinally toward the toe as illustrated in FIG. 7D, or longitudinally toward the heel.

Figure 3A:
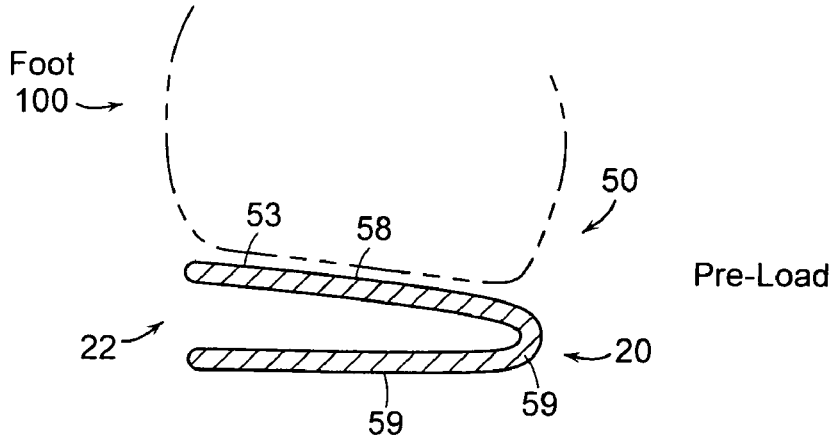
FIG. 3 is a cross-section of an embodiment, illustrating the change in shape of the cantilevered foot support during loading in the stance period of a natural gait cycle in which the foot is inverted at foot strike, is neutral to slightly everted during a portion of the stance period and is inverted again at toe-off.
Figure 3B:
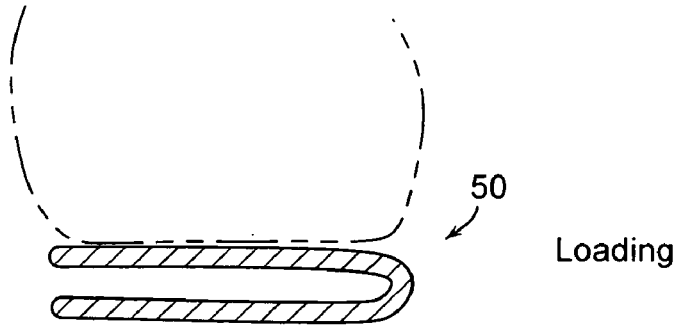
Figure 3C:
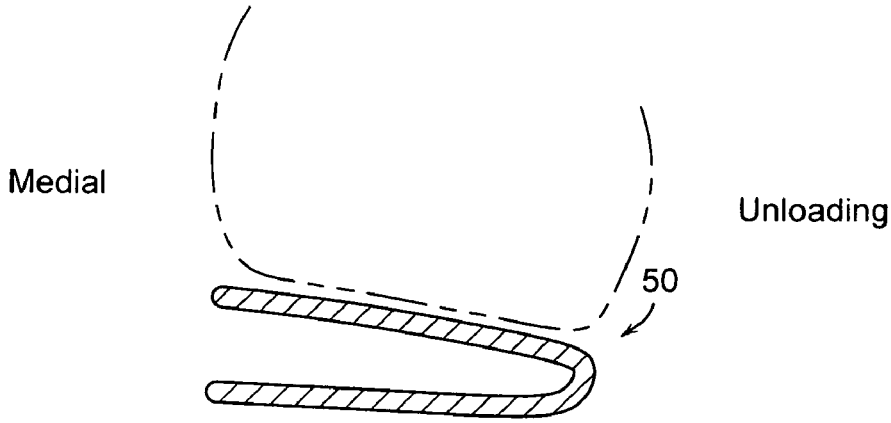

Foot support 50 may change shape during use, as illustrated in FIG. 3. For example, the foot supporting structure 58 may have an upward incline from the lateral side 20 during pre-load foot strike when the foot 100 is naturally inverted (FIG. 3A). The foot supporting structure 58 may bend downward with the weight of the body during the weight bearing or loading phase (FIG. 3B) such that the foot support 50 stores spring-like energy in this phase that is released when the foot supporting structure 58 bends upward again during unloading (FIG. 3C). This action assists with both the natural inversion and transfer of body weight force laterally. Thus, an angle between the foot supporting structure 58 and the anchoring structure 59 may change shape while the shoe is being used. The angle may be less during loading than at foot strike or during push off.

Figure 8A:
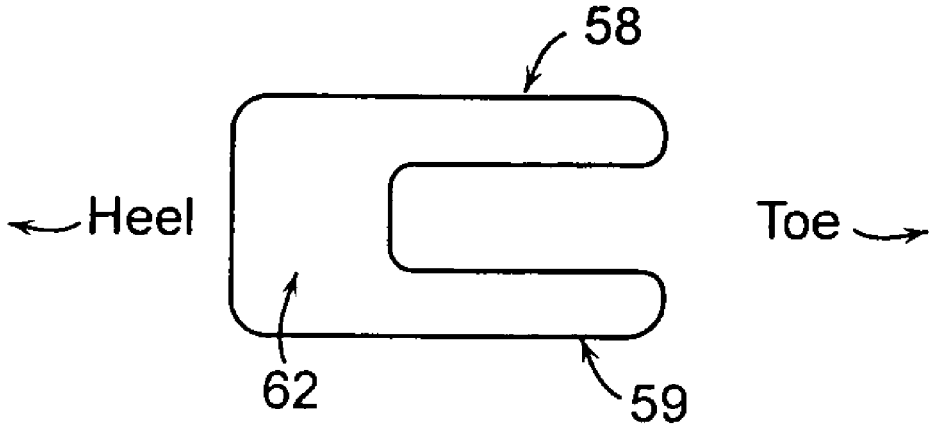
FIGS. 8A-B illustrate lateral views of possible variations in the shape of the foot support.
Figure 8B:
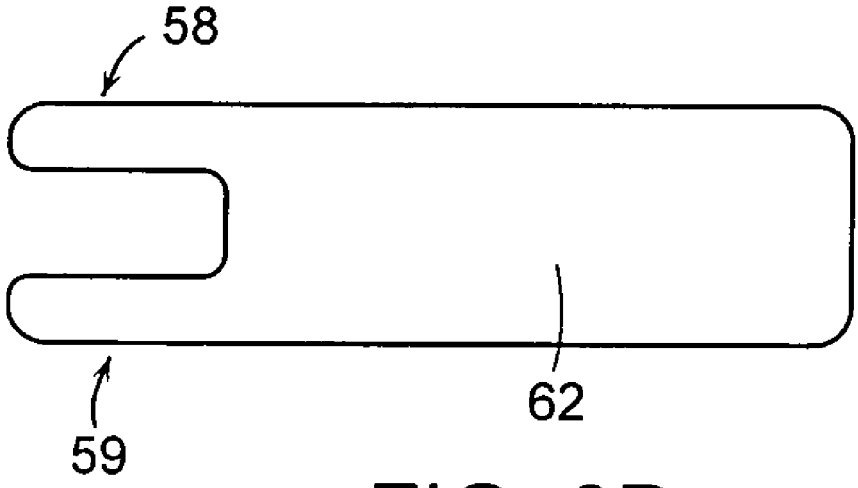

The anchoring structure 59 may have a variety of shapes. Some examples of different shapes of the anchoring structure 59 are illustrated in FIGS. 5, 7 and 8. For instance, if the lateral side 20 of the foot supporting structure 58 extends laterally to the lateral edge of the foot, the cantilevered foot support 50 may include a lateral wall 57 extending upwardly from the lateral side 20 of the foot supporting structure 58 as shown in FIG. 5C. The anchoring structure 59 may protrude beyond the foot supporting structure 58. For instance the heel edge of the anchoring structure 59 may extend toward the heel, protruding beyond the heel edge of the foot supporting structure 58, illustrated in FIG. 7C. The anchoring structure 59 and/or the foot supporting structure 58 may protrude longitudinally toward the toe (as in FIG. 8A) or heel (as in FIG. 8B) beyond a rising element 62 attaching the structures to each other. The size and shape of the anchoring structure 59 may change along the length of the foot support 50 and may be discontinuous.

Although various exemplary embodiments of the invention have been disclosed, it should be apparent to those skilled in the art that various changes and modifications can be made which will achieve some of the advantages of the invention without departing from the true scope of the invention. And it should be apparent that the invention is not limited to a foot support within a shoe, but also includes a shoe adapted to utilize any of the teachings above.

What is claimed is:

1. A footwear having a foot support for supporting weight-bearing portions of a user foot, the footwear comprising:

an upper for enclosing the user foot; and a foot support having a forefoot area, a mid-foot area, and a heel area, the foot support including:

a foot supporting structure having a lateral side and a medial side, and an anchoring structure beneath the foot supporting structure and connected to the lateral side of the foot supporting structure at either or both of the forefoot and the heel areas wherein the foot supporting structure and the anchoring structure cooperate to provide a cantilevered support projecting from the lateral side substantially on at least one of the forefoot and the heel areas and not at the mid-foot area.

2. The footwear of claim 1, wherein the foot supporting structure extends beyond the width or length of the anchoring structure.

3. The footwear of claim 1, wherein the anchoring structure extends beyond the width or length of the foot supporting structure.

4. The footwear of claim 1, wherein the medial side of the foot supporting structure is connected to the upper.

5. The footwear of claim 1, wherein the foot support changes shape during use.

6. The footwear of claim 5, wherein an angle between the foot supporting structure and the anchoring structure changes shape.

7. The footwear of claim 6, wherein the angle between the foot supporting structure and the anchoring structure is less during loading than at foot strike.

8. The footwear of claim 6, wherein the angle between the foot supporting structure and the anchoring structure is less during loading than at push off.

9. The footwear of claim 1, wherein there is a bend in the foot support on the lateral side.

10. The footwear of claim 1, wherein the anchoring structure is connected to the lateral side of the foot supporting structure at both the forefoot and the heel of the user foot so that the foot supporting structure provides cantilevered support substantially centered on both the forefoot and the heel of the user foot.

11. The footwear of claim 1, wherein the anchoring structure is connected to the lateral side of the foot supporting structure only at the forefoot and not at the heel of the user foot so that the foot supporting structure provides cantilevered support substantially centered on the forefoot of the user foot.

12. The footwear of claim 1, wherein the anchoring structure is connected to the lateral side of the foot supporting structure not at the forefoot and only the heel of the user foot so that the foot supporting structure provides cantilevered support substantially centered on the heel of the user foot.

* * * * *